US009103239B2

(12) United States Patent
Noguchi et al.

(10) Patent No.: US 9,103,239 B2
(45) Date of Patent: Aug. 11, 2015

(54) VALVE OPENING-CLOSING TIMING CONTROL DEVICE AND METHOD FOR ATTACHING FRONT MEMBER THEREOF

(71) Applicant: AISIN SEIKI KABUSHIKI KAISHA, Kariya-shi (JP)

(72) Inventors: Yuji Noguchi, Kariya (JP); Akihiko Kusaka, Kariya (JP); Atsushi Homma, Kariya (JP); Takeo Asahi, Kariya (JP); Kazunari Adachi, Kariya (JP)

(73) Assignee: AISIN SEIKI KABUSHIKI KAISHA, Kariya-Shi, Aichi (JP)

( * ) Notice: Subject to any disclaimer, the term of this patent is extended or adjusted under 35 U.S.C. 154(b) by 0 days.

(21) Appl. No.: 14/353,641

(22) PCT Filed: Dec. 10, 2012

(86) PCT No.: PCT/JP2012/081970

§ 371 (c)(1),
(2) Date: Apr. 23, 2014

(87) PCT Pub. No.: WO2013/099576

PCT Pub. Date: Jul. 4, 2013

(65) Prior Publication Data

US 2014/0311432 A1 Oct. 23, 2014

(30) Foreign Application Priority Data

Dec. 27, 2011 (JP) ..... 2011-285866
Dec. 27, 2011 (JP) ..... 2011-285867

(51) Int. Cl.
*F01L 1/34* (2006.01)
*F01L 1/344* (2006.01)
*F01L 1/047* (2006.01)

(52) U.S. Cl.
CPC ..... *F01L 1/34* (2013.01); *F01L 1/3442* (2013.01); *F01L 2001/0476* (2013.01);
(Continued)

(58) Field of Classification Search
CPC ... F01L 1/3442; F01L 1/34; F01L 2001/0476; F01L 2001/34469; F01L 2001/34483; F01L 2101/00; F01L 2250/02; F01L 2001/34479; F01L 2103/01
USPC ..... 123/90.15, 90.17, 90.31
See application file for complete search history.

(56) References Cited

U.S. PATENT DOCUMENTS 6,039,016 A 3/2000 Noguchi
7,614,372 B2 11/2009 Lichti et al.
(Continued)

FOREIGN PATENT DOCUMENTS

DE 10 2009 035 233 B3 3/2011
JP 2002-295211 A 10/2002
(Continued)

OTHER PUBLICATIONS

Extended European Search Report dated Oct. 13, 2014, issued by the European Patent Office in the corresponding European Application No. 12862669.4. (4 pages).
(Continued)

*Primary Examiner* — Zelalem Eshete
(74) *Attorney, Agent, or Firm* — Buchanan Ingersoll & Rooney PC

(57) ABSTRACT

A valve opening-closing timing control device includes: a driving rotating body that rotates synchronously with a crankshaft; a following rotating body that rotates integrally with a cam shaft; a phase control mechanism that controls changing of relative rotational phases of the driving and following rotating bodies; a torsion coil spring engaged by a front member of the driving rotating body and by the following driving body, and biases the following rotating body in an advance/retarded direction with respect to the driving rotating body. The front member includes multiple bearing surfaces to be attached with countersunk head screws, and an engaging part engaging an end of the torsion coil spring with the torsion coil spring in a twisted state. The engaging part includes a mounting part for a tool with which the end of the torsion coil spring is moved in a direction increasing torsion strength of the torsion coil spring.

7 Claims, 8 Drawing Sheets

(52) U.S. Cl.
CPC ..... *F01L 2001/34469* (2013.01); *F01L 2001/34479* (2013.01); *F01L 2001/34483* (2013.01); *F01L 2101/00* (2013.01); *F01L 2103/01* (2013.01); *F01L 2250/02* (2013.01)

(56) References Cited

U.S. PATENT DOCUMENTS

| | | | | |
|---|---|---|---|---|
| 2002/0139330 | A1* | 10/2002 | Takahashi et al. | 123/90.17 |
| 2010/0258069 | A1 | 10/2010 | Tada et al. | |
| 2011/0168112 | A1 | 7/2011 | Noguchi et al. | |

FOREIGN PATENT DOCUMENTS

| | | | |
|---|---|---|---|
| JP | 2003-120229 | A | 4/2003 |
| JP | 3846605 | B | 11/2006 |
| JP | 2010-242706 | A | 10/2010 |
| JP | 2011-140929 | A | 7/2011 |

OTHER PUBLICATIONS

International Search Report (PCT/ISA/210) mailed on Mar. 5, 2013, by the Japanese Patent Office as the International Searching Authority for International Application No. PCT/JP2012/081970.

Written Opinion (PCT/ISA/237) mailed on Mar. 5, 2013, by the Japanese Patent Office as the International Searching Authority for International Application No. PCT/JP2012/081970.

* cited by examiner

VALVE OPENING-CLOSING TIMING CONTROL DEVICE AND METHOD FOR ATTACHING FRONT MEMBER THEREOF

TECHNICAL FIELD

The present invention relates to a valve opening-closing timing control device including: a driving rotating body that rotates synchronously with a crankshaft of an internal combustion engine; a following rotating body that rotates integrally with a cam shaft of the internal combustion engine on the same rotation axis as the driving rotating body; a phase control mechanism that controls changing of relative rotational phases of the driving rotating body and the following rotating body; and a torsion coil spring that is engaged between the following rotating body and a front member provided in the driving rotating body, and biases the following rotating body with respect to the driving rotating body in an advance direction or a retarded direction, wherein the front member includes multiple bearing surfaces provided so as to be attached with countersunk head screws to the driving rotating body, and an engaging part that engages an end of the torsion coil spring with the torsion coil spring in a twisted state. The present invention relates also to a method for attaching the front member.

BACKGROUND ART

In the above-mentioned valve opening-closing timing control device, the front member includes multiple bearing surfaces in the form of conical surfaces provided so as to be attached with the countersunk head screws to the driving rotating body.

Therefore, the projecting amount of bolt heads from the front member is reduced, as compared to the case where the front member is attached with hexagonal bolts or the like to the driving rotating body, in which their bolt heads are brought into pressure contact with the flat surface of the front member. Thus, the installation thereof is easy, even into a narrow installation space, which is advantageous (see, for example, Patent Document 1).

This valve opening-closing timing control device includes the torsion coil spring that is engaged between the following rotating body and the front member, and biases the following rotating body in the advance direction or the retarded direction with respect to the driving rotating body, wherein the front member includes the engaging part capable of engaging the end of the torsion coil spring with the torsion coil spring in a twisted state.

Therefore, when the front member is attached with multiple countersunk head screws to the driving rotating body, the countersunk head screws are tightened with torsional force of the torsion coil spring acting on the front member.

CITATION LIST

Patent Literature

Patent Document 1: JP 2011-140929 A

SUMMARY OF INVENTION

Accordingly, when the front member is attached with multiple countersunk head screws to the driving rotating body, torsional force acting on the front member acts as a biasing force that causes the front member to shift relative to the driving rotating body. Therefore, the center of the countersunk head screws and the center of the bearing surfaces are likely to be eccentric to each other.

Therefore, the multiple countersunk head screws might be tightened in the state where the heads of the countersunk head screws abut the bearing surfaces on their one side while being in pressure contact therewith.

If the countersunk head screws are tightened in the state where the heads of the countersunk head screws abut the bearing surfaces on their one side while being in pressure contact therewith, the tightening of the countersunk head screws will be insufficient, which causes the pressure contact between the front member and the countersunk head screws to be loosened by an impact or the like. As a result, the attachment of the front member to the driving rotating body is loosened.

The present invention has been devised in view of the actual situations described above, and an object thereof is to provide a valve opening-closing timing control device in which the front member is attached with multiple countersunk head screws to the driving rotating body and such attachment of the front member to the driving rotating body is less likely to be loosened, and to provide a method for attaching the front member.

A first characteristic configuration of the valve opening-closing timing control device according to the present invention is that the valve opening-closing timing control device includes: a driving rotating body that rotates synchronously with a crankshaft of an internal combustion engine; a following rotating body that rotates integrally with a cam shaft of the internal combustion engine on the same rotation axis as the driving rotating body; a phase control mechanism that controls changing of relative rotational phases of the driving rotating body and the following rotating body; and a torsion coil spring that is engaged between the following rotating body and a front member provided in the driving rotating body, and biases the following rotating body with respect to the driving rotating body in an advance direction or a retarded direction, wherein the front member includes a plurality of bearing surfaces provided so as to be attached with countersunk head screws to the driving rotating body, and an engaging part that engages an end of the torsion coil spring with the torsion coil spring in a twisted state, and the engaging part includes a mounting part for a manipulating tool with which the end of the torsion coil spring is moved in a direction in which torsion strength of the torsion coil spring increases.

In the valve opening-closing timing control device according to this configuration, the engaging part that engages the end of the torsion coil spring to the front member includes the mounting part for the manipulating tool with which the end of the torsion coil spring is moved in the direction in which the torsion strength of the torsion coil spring increases.

Therefore, the end of the torsion coil spring can be moved in the direction in which the torsion strength of the torsion coil spring increases, that is, in the direction in which the engagement by the engaging part is released, using the manipulating tool mounted in the mounting part, when the front member is attached with the multiple countersunk head screws to the driving rotating body.

Accordingly, when the front member is attached with the multiple countersunk head screws to the driving rotating body, the torsion coil spring can be retained so that its torsional force does not act on the front member. Therefore, the center of the countersunk head screws and the center of the bearing surfaces are less likely to be eccentric to each other, and thus it is easy to tighten the respective multiple countersunk head screws so that the heads of the countersunk head screws do not abut the bearing surfaces on their one side.

Accordingly, with the valve opening-closing timing control device according to this configuration, the attachment between the front member and the driving rotating body is less likely to be loosened, and the front member is attached with the multiple countersunk head screws to the driving rotating body.

A second characteristic configuration of the present invention is that the mounting part is provided with a space through which the manipulating tool is insertable from a front side of the front member, between the engaging part and the end of the torsion coil spring engaged to the engaging part.

According to this configuration, operation can be conducted by inserting the manipulating tool from the front side of the front member into the space provided between the engaging part and the end of the torsion coil spring engaged to the engaging part, so that the end of the coil spring is moved away from the engaging part in the coil circumferential direction by means of the manipulating tool.

A third characteristic configuration of the present invention is that the front member includes a retaining part surrounding the outer circumferential side of a coil portion that is continuous with the end of the torsion coil spring, and an opening through which at least the inner circumferential side of the coil portion is exposed on a front side of the front member, at a position where the phase difference is 90 degrees or more with respect to the engaging part, with the rotational axis at the center.

In conventional valve opening-closing timing control devices, a front member includes an engaging part that engages an end of an torsion coil spring, and a retaining part surrounding, from the front side toward the back side of the front member, a coil portion that is continuous with the end engaged to the engaging part, over both the inner circumferential side and the outer circumferential side. Therefore, the coil portion that is continuous with the end engaged to the engaging part is retained by the retaining part in a state of standing behind the front member on the back side thereof over its entire circumference.

Such a valve opening-closing timing control device needs to use a special gripping tool, in order to simultaneously grip the front member and the coil portion that is temporarily retained by the retaining part, from the front side of the front member in the radial direction of the coil using one gripping tool. That is, it is necessary to use a special gripping tool that allows the tip of one of a pair of gripping members constituting the gripping tool to enter the front member from the front side through the retaining part further into the back side of the front member.

In the valve opening-closing timing control device according to this configuration, the front member includes the retaining part surrounding the coil portion on the outer circumferential side and the opening through which at least the inner circumferential side of the coil portion is exposed on the front side of the front member.

This configuration makes it possible to simultaneously grip, from the front side of the front member and in the radial direction of the coil, the front member and the coil portion that is temporarily retained by the retaining part on the inner circumferential side that is exposed on the front side of the front member through the opening by allowing the tip of one of the pair of gripping members constituting the gripping tool to enter the front member from the front side into the opening, without allowing it to enter the front member through the retaining part further into the back side of the front member.

Further, the opening is provided at a position such that the phase difference with respect to the engaging part is 90 degrees or more, with the rotational axis at the center.

This keeps a large distance between the gripping point in the coil portion gripped by the gripping tool and the engaged point in the torsion coil spring engaged by the engaging part, thereby stabilizing a relative posture of the torsion coil spring gripped by the gripping tool with respect to the front member.

Accordingly, the valve opening-closing timing control device according to this configuration makes it possible to efficiently perform fitting of the front member and fitting of the torsion coil spring by simultaneously gripping, from the front side of the front member and in the radial direction of the coil, the front member and the coil portion that is temporarily retained by the retaining part, using one gripping tool, without using any special gripping tools.

A fourth characteristic configuration of the present invention is that the retaining part is provided so as to be capable of retaining the coil portion over the entire circumference.

When the torsion coil spring that biases the following rotating body with respect to the driving rotating body in the advance direction or in the retarded direction is engaged between the following rotating body and the front member provided in the driving rotating body, the coil portion tends to shift in the radial direction of the spring due to the torsional deformation of the torsion coil spring.

If the coil portion shifts in the radial direction of the spring to interfere with the front member, the friction between the coil portion and the front member increases during the relative rotation of the driving rotating body and the following rotating body, which may result in failure to perform the relative rotation of the driving rotating body and the following rotating body smoothly.

According to this configuration, it is possible to restrain the coil portion from shifting in the radial direction of the spring due to the torsional deformation of the torsion coil spring, by retaining the outer circumferential side of the coil portion that is continuous with the end engaged to the engaging part, over the entire circumference.

Accordingly, the friction between the coil portion and the front member is reduced, so that the relative rotation of the driving rotating body and the following rotating body can be performed smoothly.

A fifth characteristic configuration of the present invention is that the opening is provided at a position closer to a portion opposing the engaging part than to the engaging part, with the rotational axis interposed therebetween.

The valve opening-closing timing control device according to this configuration includes the opening at a position closer to a portion opposing the engaging part than to the engaging part, with the rotational axis interposed therebetween.

This keeps a large distance between the gripping point in the coil portion gripped by the gripping tool and the engaged point in the torsion coil spring engaged by the engaging part, thereby stabilizing a relative posture of the torsion coil spring gripped by the gripping tool with respect to the front member.

A sixth characteristic configuration of the present invention is that the engaging part is provided so as to be capable of engaging, from the back side of the front member, the end of the torsion coil spring in a state of extending along a radial direction of the coil spring.

According to this configuration, it is possible to further stabilize the relative posture of the torsion coil spring gripped by the gripping tool with respect to the front member by restraining the torsion coil spring engaged to the engaging part from shifting toward the back side of the front member.

A seventh characteristic configuration of the present invention is that, in assembly of a valve opening-closing timing control device including a driving rotating body that rotates synchronously with a crankshaft of an internal combustion engine, a following rotating body that rotates integrally with a cam shaft of the internal combustion engine on the same rotation axis as the driving rotating body, a phase control mechanism that controls changing of relative rotational phases of the driving rotating body and the following rotating body, and a torsion coil spring that is engaged between the following rotating body and a front member provided in the driving rotating body, and biases the following rotating body with respect to the driving rotating body in an advance direction or a retarded direction, a method for attaching the front member of the valve opening-closing timing control device includes the steps of: mounting the torsion coil spring on the following rotating body, with one end of the torsion coil spring engaged to the following rotating body; aligning the front member with the driving rotating body while rotating the front member toward a side on which torsional force of the torsion coil spring increases, with another end of the torsion coil spring engaged to the front member; temporarily coupling the front member to the driving rotating body, with countersunk head screws inserted through a plurality of screw holes provided in the front member along with countersunk head screw-bearing surfaces; moving the other end of the torsion coil spring in a direction in which the torsional force further increases so as to maintain the front member in a state with no torsional force acting thereon; fully tightening the countersunk head screws inserted through the plurality of screw holes; and terminating the operation of moving the other end of the torsion coil spring.

According to this configuration, the method for attaching the front member, in assembly of the valve opening-closing timing control device, includes the steps of: mounting the torsion coil spring on the following rotating body, with one end of the torsion coil spring engaged to the following rotating body; aligning the front member with the driving rotating body while rotating the front member toward a side on which torsional force of the torsion coil spring increases, with the other end engaged to the front member; and temporarily coupling the front member to the driving rotating body, with countersunk head screws inserted through multiple screw holes provided in the front member along with countersunk head screw-bearing surfaces.

Accordingly, it is possible to temporarily couple the front member to the driving rotating body, with the countersunk head screws inserted through the multiple screw holes, while fitting the torsion coil spring to the following rotating body and the front member under torsional deformation.

However, in such a temporarily coupled state, torsional force of the torsion coil spring is acting on the front member, and therefore the center of the countersunk head screws and the center of the bearing surfaces are likely to be eccentric to each other. Thus, if the countersunk head screws are fully tightened as they are, the countersunk head screws might be tightened in the state where the heads of the countersunk head screws abut the bearing surfaces on their one side.

Therefore, the method for attaching the front member according to this configuration includes the steps of: moving the other end of the torsion coil spring in the direction in which the torsional force further increases so as to maintain the front member in a state with no torsional force acting thereon; fully tightening the countersunk head screws inserted through the multiple screw holes; and terminating the operation of moving the other end of the torsion coil spring.

Accordingly, the countersunk head screws are fully tightened in a state where the torsional force does not act on the front member, that is, in a state where one-sided abutment is less likely to occur due to eccentricity between the center of the countersunk head screws and the center of the bearing surfaces, and thereafter the moving operation on the other end of the torsion coil spring is terminated, thereby allowing the torsional force to act on the front member.

Therefore, according to the method for attaching the front member of the valve opening-closing timing control device according to this configuration, the front member is attached with multiple countersunk head screws to the driving rotating body and such attachment of the front member to the driving rotating body is less likely to be loosened.

DESCRIPTION OF EMBODIMENTS

Hereinafter, embodiments of the present invention are described with reference to the drawings.

FIG. 1 to FIG. 5 show a valve opening-closing timing control device according to the present invention to be installed in an automotive engine (which is an example of internal combustion engines).

Overall Configuration

Figure 1:
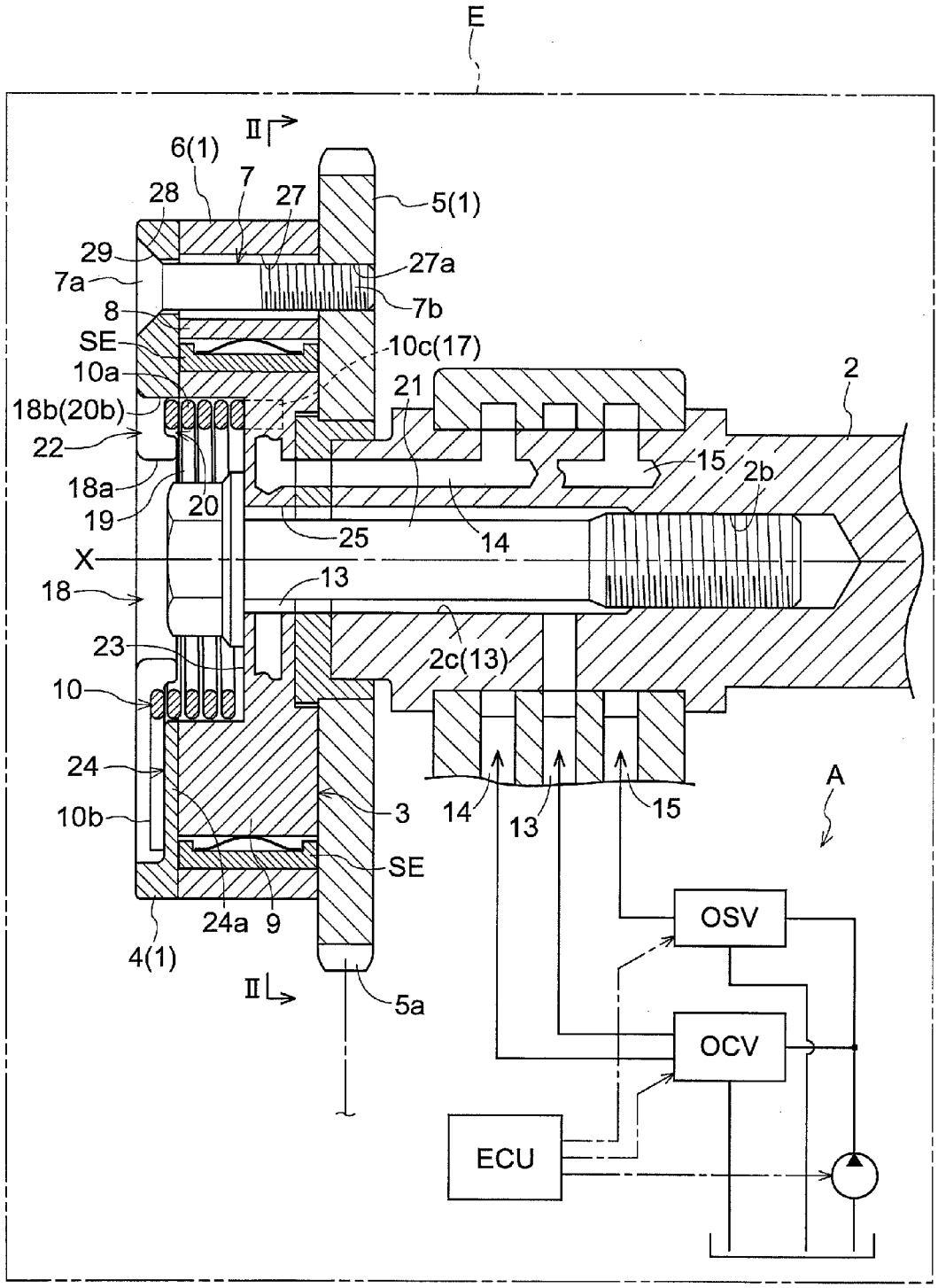
FIG. 1 is a vertical sectional view (sectional view taken along the line I-I in FIG. 3 as seen in the direction of the arrows) showing an overall configuration of a valve opening-closing timing control device.

As shown in FIG. 1, the valve opening-closing timing control device includes a housing 1 (an example of driving rotating bodies) made of steel that rotates synchronously with a crankshaft (not shown) of an engine E, an inner rotor 3 (an example of following rotating bodies) made of aluminum alloy that rotates integrally with a cam shaft 2 of the engine E, a torsion coil spring 10 that biases the inner rotor 3 with respect to the housing 1 in the advance direction (direction of the arrow S1 in FIG. 2), and a phase control mechanism A that controls changing of relative rotational phases of the housing 1 and the inner rotor 3.

The housing 1 and the inner rotor 3 rotate on the same axis X.

Housing and Rotor

As shown in FIG. 1 to FIG. 5, the housing 1 includes a front plate (an example of front members) 4 on the front side, that is, on the opposite side of the cam shaft 2 side, a wall member 5 on the back side, that is, on the cam shaft 2 side, and an outer rotor 6 interposed between the front plate 4 and the wall member 5.

The front plate 4, the outer rotor 6, and the wall member 5 are attached to one another with four countersunk head screws 7 in a mutually tightened state. A sprocket 5*a* to which power from the crankshaft is transmitted is provided around the outer circumferential portion of the wall member 5. The torsion coil spring 10 is engaged between the front plate 4 and the inner rotor 3 in a state of being twisted and deformed in the diameter decreasing direction.

Figure 2:
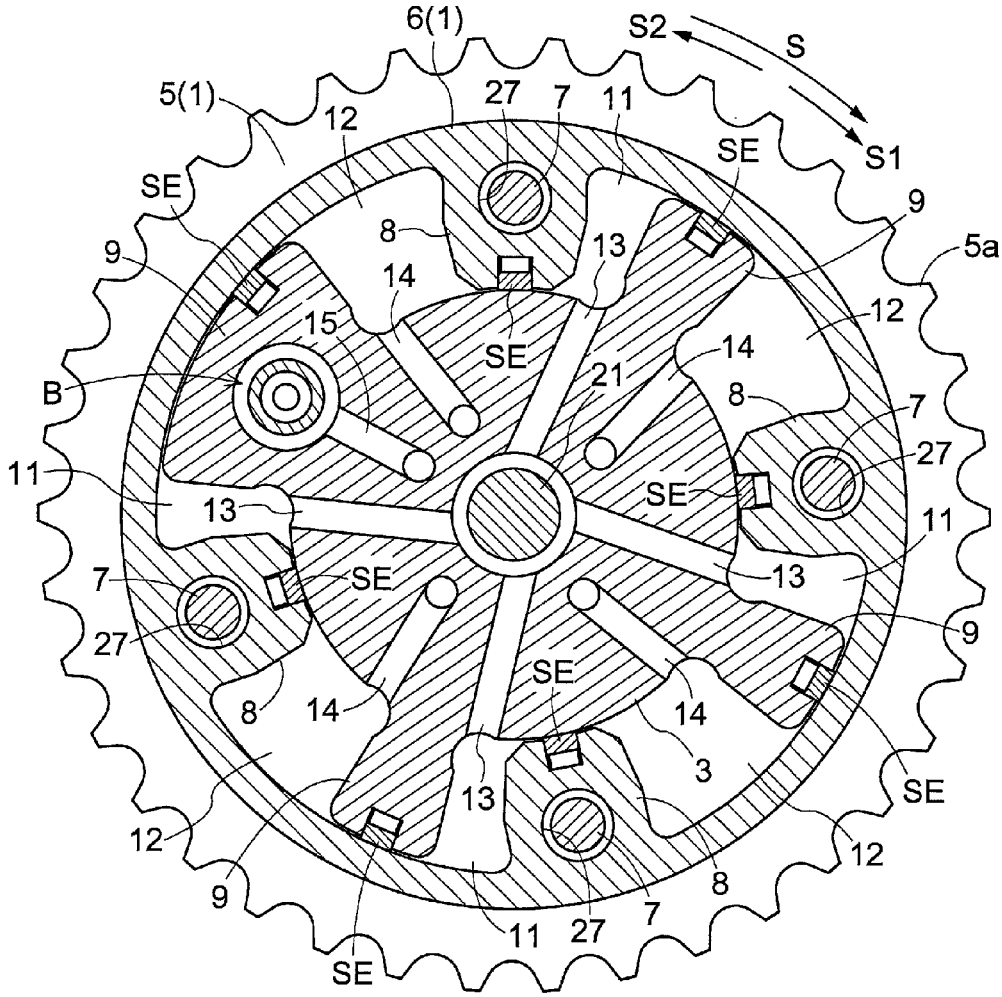
FIG. 2 is a sectional view taken along the line II-II in FIG. 1 as seen in the direction of the arrows.

When the crankshaft is driven to rotate, a rotational driving force is transmitted to the wall member 5 via a power transmission member (not shown) such as a chain, and the outer rotor 6 rotates in the direction indicated by the arrow S in FIG. 2.

As the outer rotor 6 is driven to rotate, the inner rotor 3 is driven to rotate in the rotational direction S via oil inside an advance chamber 11 and a retard chamber 12. As a result, the cam shaft 2 is rotated, so that a cam (not shown) provided on the cam shaft 2 actuates an intake valve of the engine E.

In the inner circumferential portion of the outer rotor 6, multiple first partitioning parts 8 that project inwardly in the radial direction are formed. These first partitioning parts 8 are arranged at intervals along the rotational direction S.

In the outer circumferential portion of the inner rotor 3, multiple second partitioning parts 9 that project outwardly in the radial direction are formed. These second partitioning parts 9 are arranged at intervals along the rotational direction S, in the same manner as the first partitioning parts 8.

The first partitioning parts 8 partition the space between the outer rotor 6 and the inner rotor 3 into multiple fluid pressure chambers. The second partitioning parts 9 partition each of these fluid pressure chambers into the advance chamber 11 and the retard chamber 12.

Furthermore, in order to prevent oil leakage between the advance chamber 11 and the retard chamber 12, a seal member SE is provided at each of a position opposing the outer circumferential surface of the inner rotor 3 in the first partitioning parts 8 and a position opposing the inner circumferential surface of the outer rotor 6 in the second partitioning parts 9.

As shown in FIG. 1 and FIG. 2, the phase control mechanism A supplies and discharges oil and blocks the supply and discharge thereof to and from the advance chambers 11 and the retard chambers 12, thereby controlling changing of relative rotational phases of the housing 1 and the inner rotor 3.

Formed inside the cam shaft 2 and the inner rotor 3 are advance chamber passages 13 that connect between each advance chamber 11 and the phase control mechanism A, retard chamber passages 14 that connect between each retard chamber 12 and the phase control mechanism A, and a locking passage 15 that connects between a locking mechanism B configured to lock the inner rotor 3 and the outer rotor 6 at a specific relative rotational phase and the phase control mechanism A.

The phase control mechanism A includes an oil pan, an oil motor, a fluid control valve OCV that supplies and discharges engine oil, and blocks the supply and discharge thereof, to and from the advance chamber passages 13 and the retard chamber passages 14, a fluid switching valve OSV that supplies and discharges engine oil, and blocks the supply and discharge thereof, to and from the locking passage 15, and an electronic control unit ECU that controls the actuation of the fluid control valve OCV and the fluid switching valve OSV.

The control operation performed by the phase control mechanism A causes the inner rotor 3 to be displaced in the advance direction (direction indicated by the arrow S1 in FIG. 2) or the retarded direction (direction indicated by the arrow S2 in FIG. 2) with respect to the outer rotor 6, so that the relative rotational phase of the inner rotor 3 and the outer rotor 6 is maintained at an arbitrary phase.

The inner rotor 3 and the cam shaft 2 are fastened by a bolt 21 so as to be attached to each other. The bolt 21 is fastened to an internally threaded part 2*b* formed on the far side of an insertion through hole 2*c* provided at the tip of the cam shaft 2. This allows the inner rotor 3 to be integrally attached to the tip of the cam shaft 2.

A through hole 25 through which the bolt 21 is inserted is formed through the inner rotor 3, and a recessed portion 23 that houses the head of the bolt 21 on the front plate 4 side of the through hole 25 is formed.

The gaps of the through hole 25 of the inner rotor 3 and the insertion through hole 2*c* of the cam shaft 2 with respect to the bolt 21 function as an advance chamber passage 13.

Fitting Structure of the Torsion Coil Spring

As shown in FIG. 1 and FIG. 3 to FIG. 5, the torsion coil spring 10 has, at the ends of a spring body 10*a* formed by winding a wire with a circular cross section into a coil, an outer rotor-side spring end 10*b* that is engaged by a front engaging part 16 provided in the front plate 4, and an inner rotor-side spring end 10*c* that is engaged by a rotor engaging part 17 provided in the inner rotor 3.

The outer rotor-side spring end 10*b* is provided in a posture of projecting outwardly of the spring body 10*a* in the radial direction of the coil spring.

The inner rotor-side spring end 10*c* is provided in a posture of projecting in the longitudinal direction of the spring body 10*a* so as to be inserted into the rotor engaging part 17 that is formed into a hole extending parallel to the axis X.

The front plate 4 is in the form of a plate with a circular outline including a multi-diameter through hole 18.

The multi-diameter through hole 18 is formed into a shape including two inner arcuate portions 18*a* of the same diameter and two outer arcuate portions 18*b* of the same diameter provided alternately in the circumferential direction.

The inner arcuate portions 18*a* are formed coaxially with the axis X with a diameter that is smaller than the internal diameter of a coil portion 19 of the spring body 10*a*, in a twisted and deformed state, that is continuous with the outer rotor-side spring end 10*b*. The outer arcuate portions 18*b* are formed coaxially with the axis X with the same diameter as the internal diameter of the recessed portion 23 of the inner rotor 3.

The two inner arcuate portions 18*a* are arranged opposing each other in the diameter direction across the axis X, and the outer arcuate portions 18*b* are each arranged between these inner arcuate portions 18*a*.

On the back side (on the outer rotor 6 side) of the plate portions extending along the two inner arcuate portions 18*a* and the two outer arcuate portions 18*b*, a retaining part 20 is provided so as to continuously surround the entire circumference of one turn of the coil portion 19, on the outer circumferential side, that is continuous with the outer rotor-side spring end 10*b* engaged to the rotor engaging part 17. The retaining part 20 is formed into a spiral shape that conforms to the pitch angle of the spring body 10*a* that is torsionally deformed.

The retaining part 20 includes a series of first retaining parts 20*a* provided in the plate portions extending along the two inner arcuate portions 18*a*, and second retaining parts 20*b* provided in the plate portions extending along the two outer arcuate portions 18*b*.

The first retaining parts 20*a* extending along the inner arcuate portions 18*a* are provided so as to form a groove that continuously surrounds the outer circumferential side and the inner circumferential side of the coil portion 19. The second retaining parts 20*b* extending along the outer arcuate portions 18*b* are composed of end surfaces that form the outer arcuate portions 18*b* that surround only the outer circumferential side of the coil portion 19.

Accordingly, the portions of the multi-diameter through hole 18 that are formed by the two outer arcuate portions 18*b* are provided as an opening 22 through which at least the inner circumferential side of the coil portion is exposed on the front side of the front plate 4.

One of the two outer arcuate portions 18*b* is provided with the front engaging part 16 that engages the outer rotor-side spring end 10*b* in the circumferential direction of the coil spring with the torsion coil spring 10 in a twisted state.

The other of the outer arcuate portions 18*b* constituting the opening 22 is provided at a position where the phase difference with respect to the front engaging part 16 is 90 degrees or more, with the rotational axis X at the center, that is, at a position closer to a portion opposing the engaging part 16 than to the engaging part 16, with the rotational axis X interposed therebetween.

The front engaging part 16 is provided with a recessed surface 24 that opens over the one outer arcuate portion 18*b* on the front side of the front member 4, so as to be provided with an engaging surface 26 that engages the outer rotor-side spring end 10*b* by being abutted in the circumferential direction of the coil spring and so as to be provided capable of engaging it from the back side of the front plate 4 by a bottom portion 24*a* of the recessed surface 24.

The front engaging part 16 receives torsional force of the torsion coil spring 10 having the inner rotor-side spring end 10*c* engaged to the rotor engaging part 17, by the engaging surface 26 via the outer rotor-side spring end 10*b*, thereby biasing the inner rotor 3 with respect to the outer rotor 6 in the advance direction.

Four screw holes 27 through which the countersunk head screws 7 are inserted are formed passing through the front plate 4, the outer rotor 6, and the wall member 5.

The screw hole portions in the front plate 4 of the screw holes 27 are respectively provided with countersunk head screw-bearing surfaces 29 in the form of conical surfaces with which pressure contact surfaces 28 in the form of conical surfaces that are formed at the heads 7*a* of the countersunk head screws 7 are brought into pressure contact, so that the front plate 4 is attached to the outer rotor 6 and the wall member 5 with the countersunk head screws 7.

The screw hole portions in the wall member 5 of the screw holes 27 are provided with internally threaded parts 27*a* with which externally threaded parts 7*b* of the countersunk head screws 7 are threadedly engaged.

The front engaging part 16 includes a mounting part 30 for a manipulating tool such as a screwdriver which is operated to move the outer rotor-side spring end 10*b* in the direction in which the torsion strength of the torsion coil spring 10 increases, that is, in the direction in which the outer rotor-side spring end 10*b* moves away from the engaging surface 26.

The mounting part 30 has a configuration in which a space 32, into which the tip portion of the manipulating tool can enter from the front side of the front member 4, is provided between the engaging surface 26 and the outer rotor-side spring end 10*b* engaged to the engaging surface 26, by forming a notch part 31 in part of the engaging surface 26.

Method for Attaching Front Plate

FIG. 6 to FIG. 11 are explanatory diagrams illustrating a method for attaching the front plate 4 according to the present invention, in assembly of the above-mentioned valve opening-closing timing control device.

The method for attaching the front plate 4 includes a first step to a fourth step shown in FIG. 6 to FIG. 11, and fifth and sixth steps, in numerical order.

Figure 6:
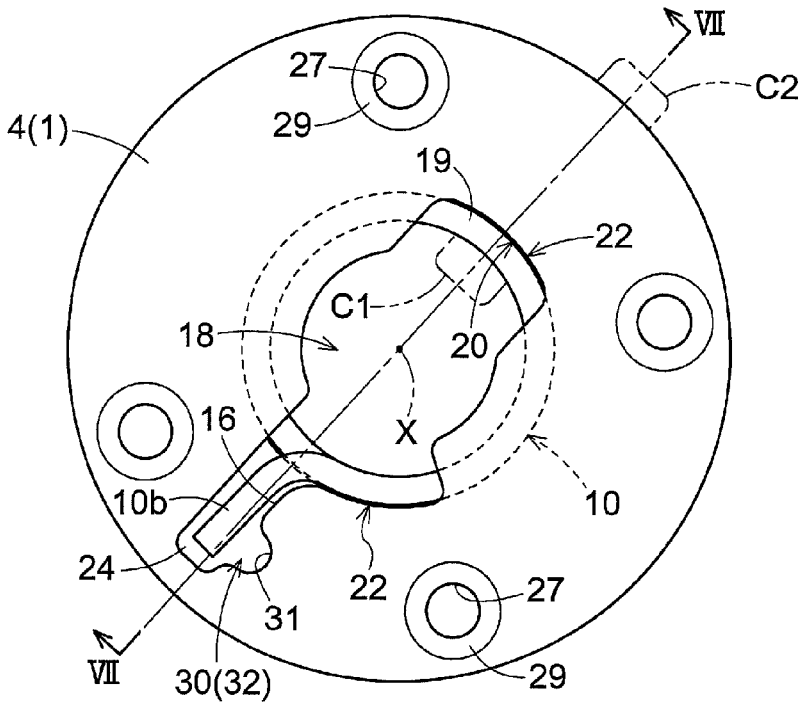
FIG. 6 is a front view for explaining a method for attaching the front member.
Figure 7:
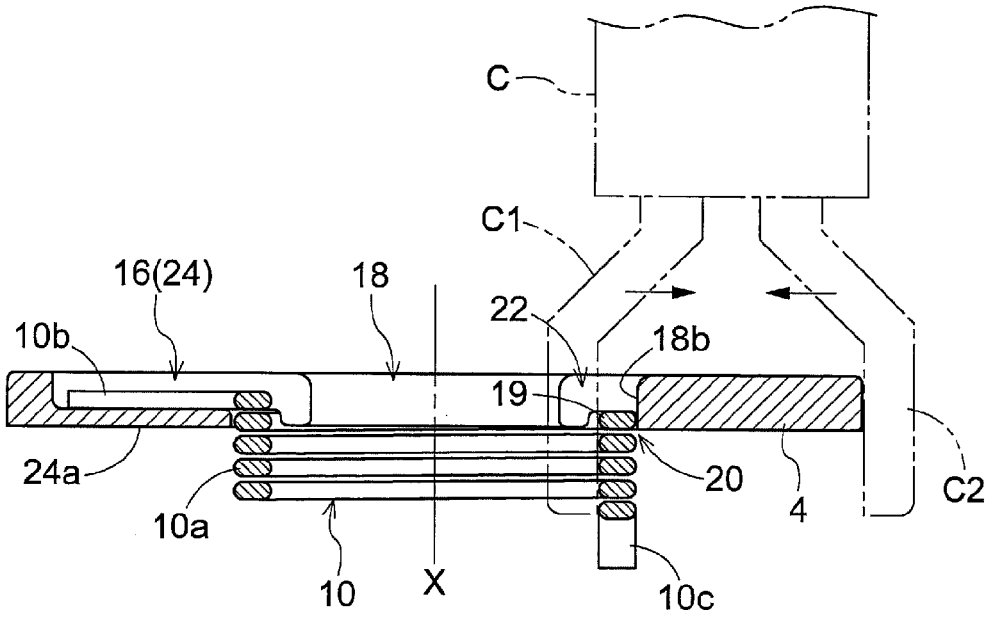
FIG. 7 is a sectional view for explaining the method for attaching the front member.

In the first step, as shown in FIG. 6, FIG. 7, the coil portion 19 is temporarily retained by the retaining part 20, and the outer rotor-side spring end 10*b* is temporarily engaged to the front engaging part 16. Thus, the torsion coil spring 10 is temporarily coupled to the front plate 4.

The torsion coil spring 10 and the front plate 4 thus temporarily coupled are simultaneously gripped with one gripping tool C as shown in FIG. 7, and the torsion coil spring 10 is mounted on the inner rotor 3 while the inner rotor-side spring end 10*c* is inserted into the rotor engaging part 17 in engagement therewith.

The torsion coil spring 10 and the front plate 4 are gripped with the gripping tool C as follows. The tip of one gripping member C1 of a pair of gripping members C1 and C2 is inserted into the opening 22 from the front side of the front member 4, so that the front plate 4 and the coil portion 19 extending along the outer arcuate portion 18*b*, that is, the inner circumferential side of a portion exposed on the front side of the front member 4 through the opening 22 are simultaneously gripped in the radial direction of the coil.

Figure 8:
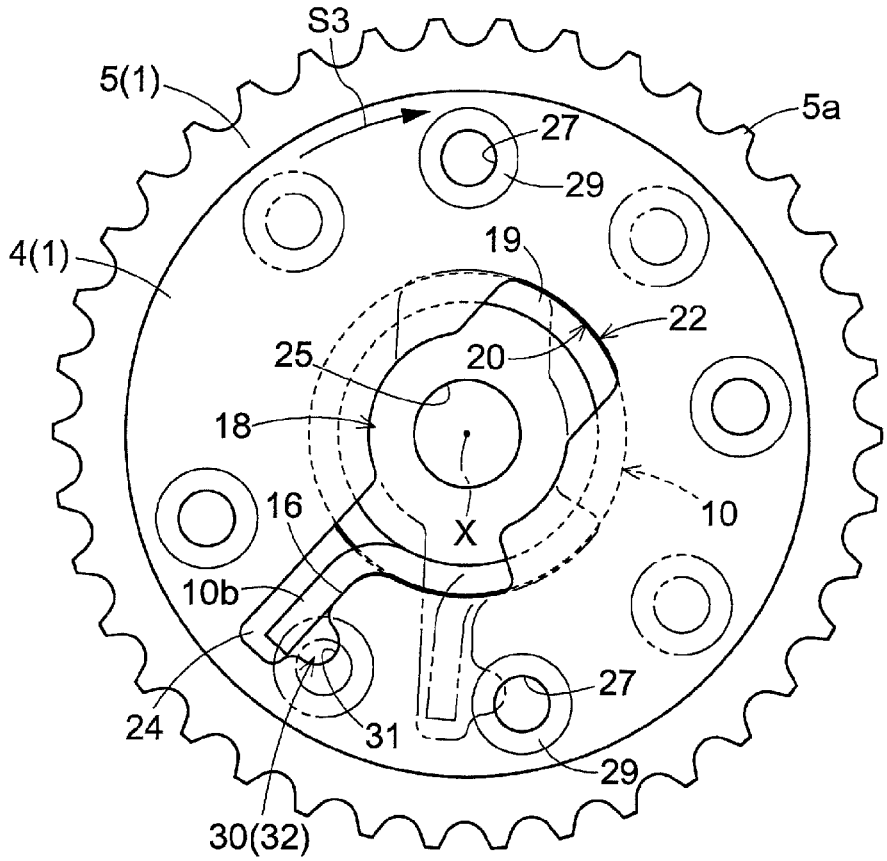
FIG. 8 is a front view for explaining the method for attaching the front member.

In the second step, as shown in FIG. 8, while the front plate 4 is rotated toward the side on which the torsional force of the torsion coil spring 10 increases (in the direction indicated by the arrow S3) with the outer rotor-side spring end 10*b* engaged to the front engaging part 16, the front plate 4 is positioned relative to the outer rotor 6 and the wall member 5 so that the four screw holes 27 each provide coaxial communication through the front plate 4, the outer rotor 6, and the wall member 5.

Figure 9:
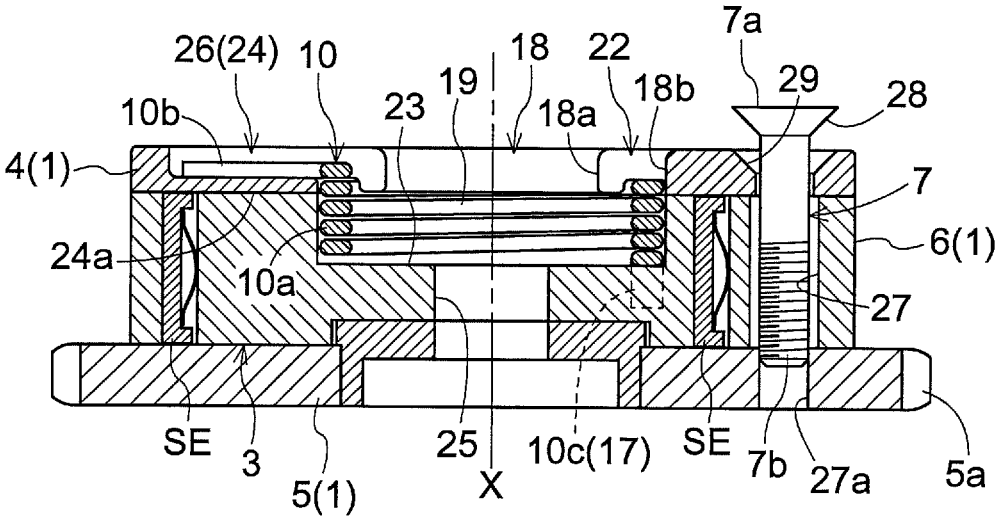
FIG. 9 is a sectional view of a main part for explaining the method for attaching the front member.

In the third step, as shown in FIG. 9, the countersunk head screws 7 that are inserted respectively through the four screw holes 27 provided in the front plate 4 with the bearing surfaces 29 are temporarily tightened to the wall member 5. Thus, the front plate 4 is temporarily coupled to the outer rotor 6 and the wall member 5.

Figure 10:
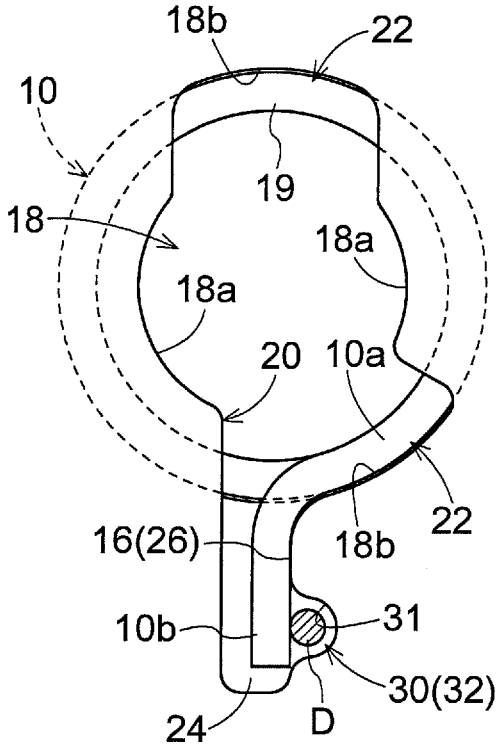
FIG. 10 is a front view of a main part for explaining the method for attaching the front member, in a state where the tip of a manipulating tool is mounted in a mounting part.
Figure 11:
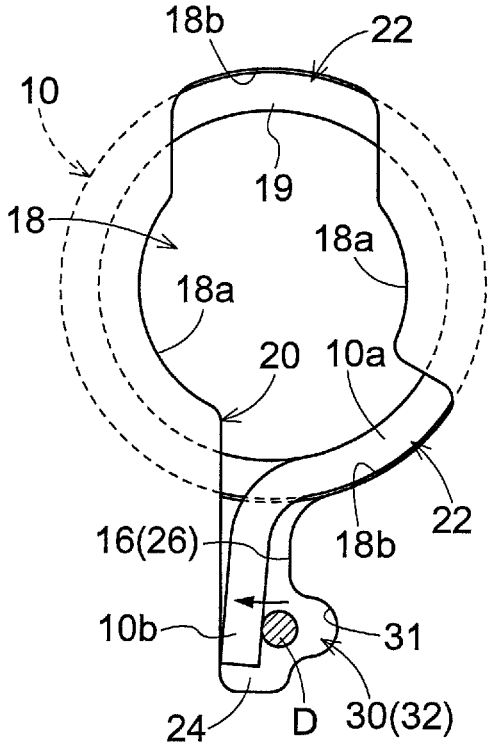
FIG. 11 is a front view of a main part for explaining the method for attaching the front member, in a state where an outer rotor-side spring end is moved in a direction in which torsional force further increases.

In the fourth step, as shown in FIG. 10, a tip portion D of a manipulating tool such as a screwdriver is inserted into the mounting part 30 from the front side of the front member 4, and is operated to move the outer rotor-side spring end 10*b*, as shown in FIG. 11, in the direction in which the outer rotor-side spring end 10*b* moves away from the engaging surface 26, that is the direction in which the torsional force further increases. In this way, the front plate 4 is maintained with no torsional force acting thereon.

Figure 3:
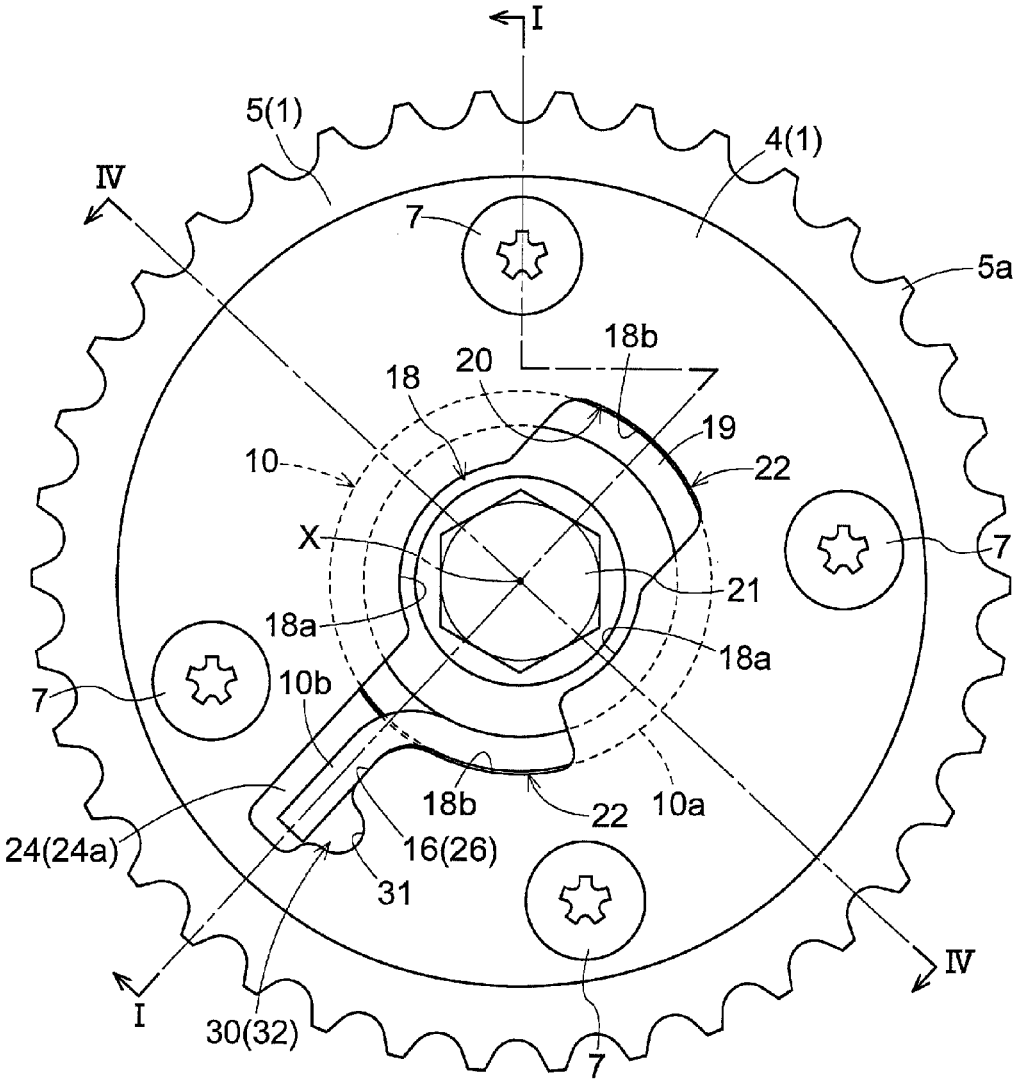
FIG. 3 is a front view of the valve opening-closing timing control device.
Figure 4:
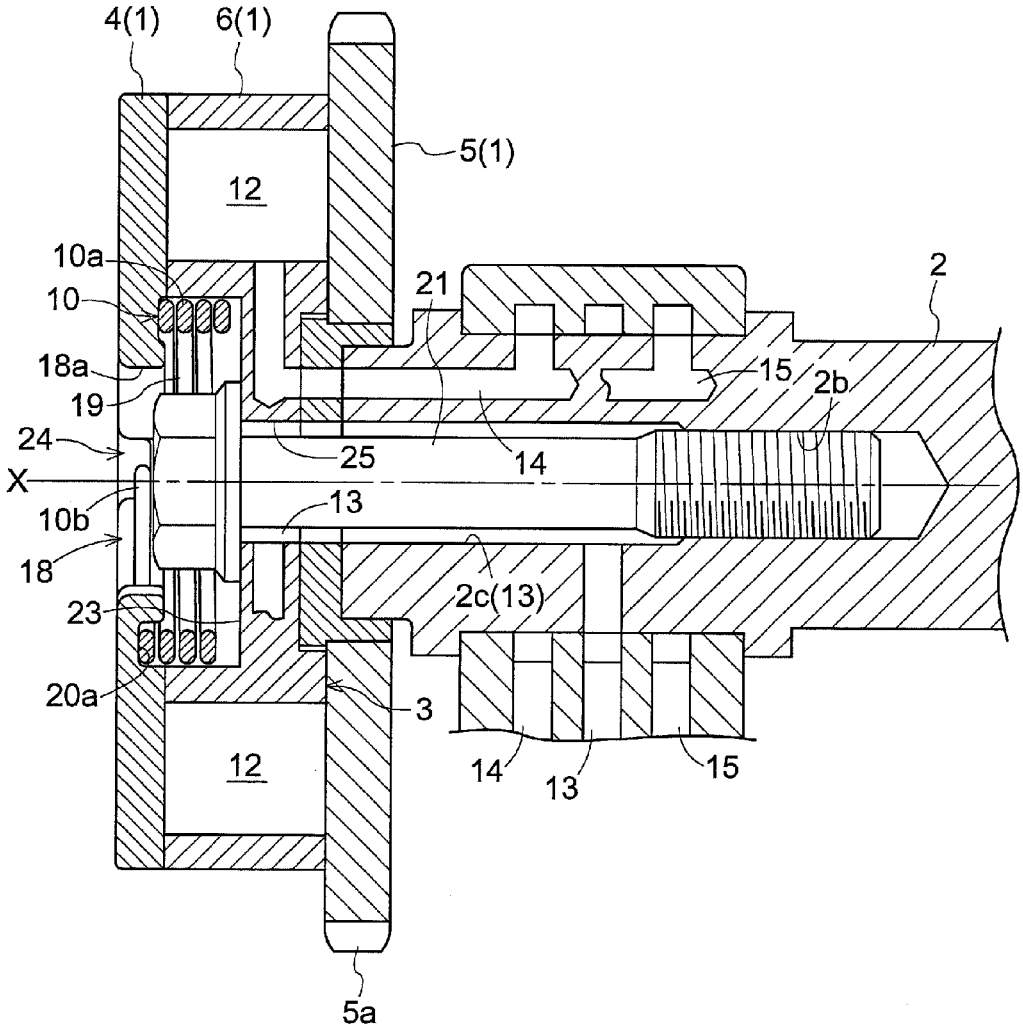
FIG. 4 is a sectional view of a main part taken along the line IV-IV in FIG. 3 as seen in the direction of the arrows.
Figure 5:
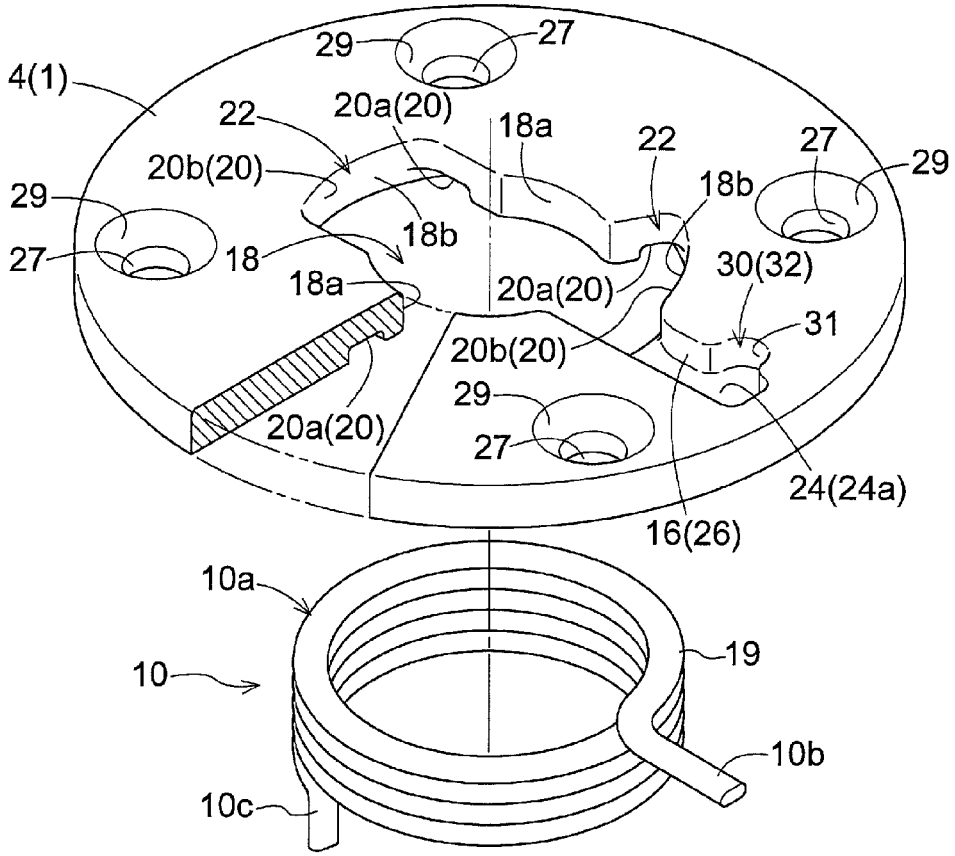
FIG. 5 is a perspective view showing a front member and a torsion coil spring.

In the fifth step, as shown in FIG. 1, the countersunk head screws 7 inserted through the four screw holes 27 are fully tightened simultaneously. In the sixth step, the tip portion D of the manipulating tool is withdrawn from the mounting part 30, the operation of moving the outer rotor-side spring end 10*b* of the torsion coil spring 10 is terminated, and the outer rotor-side spring end 10*b* is engaged to the engaging surface 26, as shown in FIG. 3.

Other Embodiments

1. The valve opening-closing timing control device according to the present invention may include the torsion coil spring 10 that biases the following rotating body 3 with respect to the driving rotating body 1 in the retarded direction.

2. The valve opening-closing timing control device according to the present invention may have a configuration in which the end 10*b* of the coil spring 10 projects from the front member 4 on the front side or outwardly in the radial direction thereof, so as to be engaged by the engaging part 16 movably in the direction in which the torsion strength of the torsion coil spring 10 increases, and the mounting part 30 for the manipulating tool with which the end 10*b* of the torsion coil spring 10 is moved in the direction in which the torsion strength of the torsion coil spring 10 increases is composed of the portion of the end 10*b* projecting from the front member 4.

3. The valve opening-closing timing control device according to the present invention may include a front member having a boss for shaft insertion and a flange for attachment, in addition to the front member 4 in the form of a plate.

INDUSTRIAL APPLICABILITY

The present invention can be used for valve opening-closing timing control devices of automobiles and other internal combustion engines.

The invention claimed is:

1. A valve opening-closing timing control device comprising:

a driving rotating body that rotates synchronously with a crankshaft of an internal combustion engine;

a following rotating body that rotates integrally with a cam shaft of the internal combustion engine on the same rotation axis as the driving rotating body;

a phase control mechanism that controls changing of relative rotational phases of the driving rotating body and the following rotating body; and a torsion coil spring that is engaged between the following rotating body and a front member provided in the driving rotating body, and biases the following rotating body with respect to the driving rotating body in an advance direction or a retarded direction, wherein the front member includes a plurality of bearing surfaces provided so as to be attached with countersunk head screws to the driving rotating body, and an engaging part that engages an end of the torsion coil spring with the torsion coil spring in a twisted state, and the engaging part includes a mounting part for a manipulating tool with which the end of the torsion coil spring is moved in a direction in which torsion strength of the torsion coil spring increases.

2. The valve opening-closing timing control device according to claim 1, wherein the mounting part is provided with a space through which the manipulating tool is insertable from a front side of the front member, between the engaging part and the end of the torsion coil spring engaged to the engaging part.

3. The valve opening-closing timing control device according to claim 1, wherein the front member includes: a retaining part surrounding the outer circumferential side of a coil portion that is continuous with the end of the torsion coil spring; and an opening through which at least the inner circumferential side of the coil portion is exposed on a front side of the front member, at a position where the phase difference is 90 degrees or more with respect to the engaging part, with the rotational axis at the center.

4. The valve opening-closing timing control device according to claim 3, wherein the retaining part is provided so as to be capable of retaining the coil portion over the entire circumference.

5. The valve opening-closing timing control device according to claim 3, wherein the opening is provided at a position closer to a portion opposing the engaging part than to the engaging part, with the rotational axis interposed therebetween.

6. The valve opening-closing timing control device according to claim 1, wherein the engaging part is provided so as to be capable of engaging, from the back side of the front member, the end of the torsion coil spring in a state of extending along a radial direction of the coil spring.

7. A method for attaching a front member of a valve opening-closing timing control device, in assembly of the valve opening-closing timing control device including: a driving rotating body that rotates synchronously with a crankshaft of an internal combustion engine; a following rotating body that rotates integrally with a cam shaft of the internal combustion engine on the same rotation axis as the driving rotating body; a phase control mechanism that controls changing of relative rotational phases of the driving rotating body and the following rotating body; and a torsion coil spring that is engaged between the following rotating body and the front member provided in the driving rotating body, and biases the following rotating body with respect to the driving rotating body in an advance direction or a retarded direction, the method comprising the steps of:

mounting the torsion coil spring on the following rotating body, with one end of the torsion coil spring engaged to the following rotating body;

aligning the front member with the driving rotating body while rotating the front member toward a side on which torsional force of the torsion coil spring increases, with another end of the torsion coil spring engaged to the front member, temporarily coupling the front member to the driving rotating body, with countersunk head screws inserted through a plurality of screw holes provided in the front member along with countersunk head screw-bearing surfaces;

moving the other end of the torsion coil spring in a direction in which the torsional force further increases so as to maintain the front member in a state with no torsional force acting thereon;

fully tightening the countersunk head screws inserted through the plurality of screw holes; and terminating the operation of moving the other end of the torsion coil spring.

* * * * *